US006629859B2

(12) United States Patent
Hoshino et al.

(10) Patent No.: US 6,629,859 B2
(45) Date of Patent: Oct. 7, 2003

(54) SHIELDED CONNECTOR ASSEMBLY

(75) Inventors: Hirokazu Hoshino, Saitama (JP); Junya Tsuji, Tokyo (JP); Takashi Futatsugi, Tokyo (JP); Ken Takaki, Kanagawa (JP)

(73) Assignee: Tyco Electronics AMP K.K., Kanagawa (JP)

( * ) Notice: Subject to any disclaimer, the term of this patent is extended or adjusted under 35 U.S.C. 154(b) by 0 days.

(21) Appl. No.: 10/061,697

(22) Filed: Feb. 1, 2002

(65) Prior Publication Data

US 2002/0102879 A1 Aug. 1, 2002

(30) Foreign Application Priority Data

Jan. 31, 2001 (JP) ..... 2001-024484

(51) Int. Cl.[7] ..... H01R 13/648
(52) U.S. Cl. ..... 439/607
(58) Field of Search ..... 439/607, 608, 439/609, 610, 108

(56) References Cited

U.S. PATENT DOCUMENTS 5,055,070 A * 10/1991 Plegge et al. ..... 439/609
5,171,167 A * 12/1992 Kosmala ..... 439/607
6,227,910 B1 * 5/2001 Huang ..... 439/610
6,371,810 B1 * 4/2002 Iwasaki ..... 439/607

FOREIGN PATENT DOCUMENTS

JP 10-064636 3/1998 ..... H01R/23/68

* cited by examiner

*Primary Examiner*—Ross N. Gushi
(74) *Attorney, Agent, or Firm*—Barley, Snyder, Senft & Cohen, LLC

(57) ABSTRACT

A shielded connector assembly having an insulating housing having front and rear parts, and female connector parts. Contacts are disposed in the female connector parts. A metal shell is attached to the insulating housing. The metal shell has a specified plate thickness and has grounding tongues that elastically contact mating male connectors that are connected to the female connector parts. A front shell made of metal is externally mounted on the front part of the insulating housing. The front shell has a plate thickness thicker than the metal shell and is fastened to the insulating housing by crimping such that it contacts the metal shell. A metal rear shell is externally mounted on the insulating housing from the rear part of the insulating housing such that the front shell and the rear shell are mechanically and electrically engaged with each other.

7 Claims, 7 Drawing Sheets

Fig. 12 A
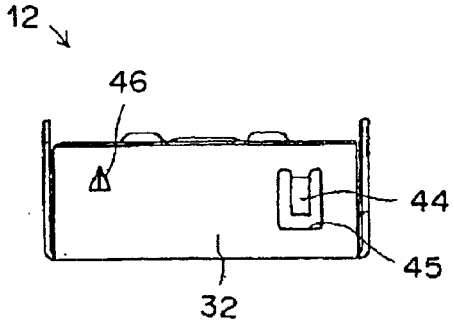
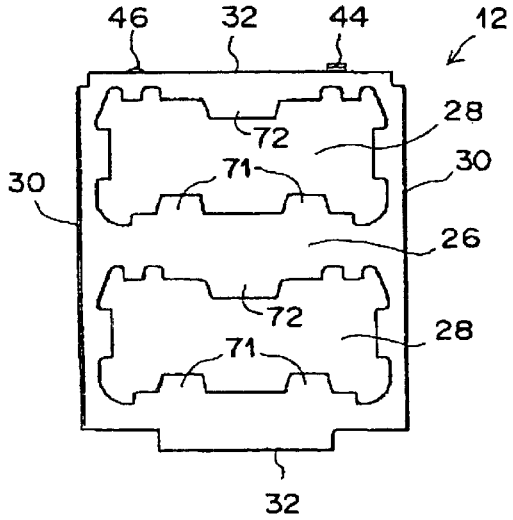
Fig. 12 B
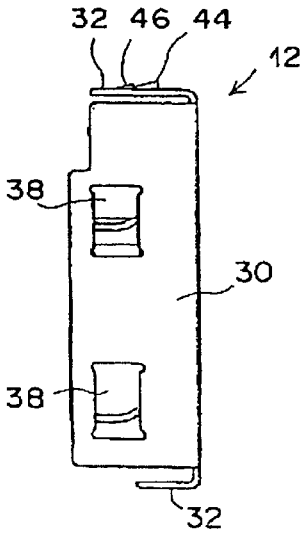
Fig. 12 C
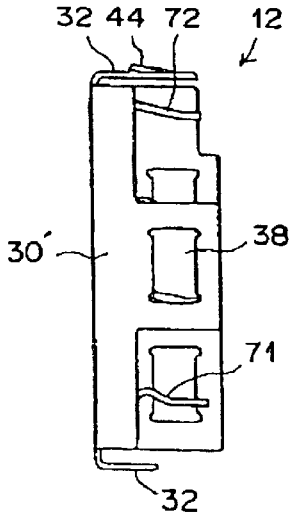
Fig. 12 D

SHIELDED CONNECTOR ASSEMBLY

BACKGROUND OF THE INVENTION

The present invention relates to a shielded connector assembly and, more specifically, to a shielded connector assembly suitable for high-speed transmission.

DESCRIPTION OF THE PRIOR ART

Shielded connector assemblies suitable for high-speed transmission are commonly used in household game devices or personal computers, etc. Connector assemblies of this type are mounted on attachment boards in equipment, and external connectors are inserted to establish electrical connections. Since the connectors are used in high-speed transmission, the peripheries of the connectors are generally shielded. One example of such an electrical connector is disclosed in Japanese Unexamined Patent Publication No. 10(1998)-64636. This electrical connector has a main body consisting of a molded synthetic resin, and a socket shield or metal shell that covers the main body. The socket shield is grounded to a panel of the device housing body via a contact part or tongue. This panel also forms a guide or engaging part that accommodates a mating connector.

In this type of connector assembly, the connector assembly is fastened to the board, but is not fastened to the panel. As a result, in cases where wrenching occurs with respect to the connector when the mating connector is inserted and removed or in cases where the connector moves relative to the panel, positional deviation occurs between the panel and the electrical connector. As a result of this positional deviation, smooth insertion and removal of the connector becomes virtually impossible. Further, the grounding tongue which is grounded by contacting the mating connector, and which has a specified elasticity stipulated by standards, is formed on the socket shield.

It is therefore desirable to develop a shielded connector assembly that is capable of both satisfying the metal shell plate thickness requirement stipulated by standards and having a strong panel or connector engaging part front shell. It is also desirable to develop a shielded connector assembly in which relative positional deviation between the metal shell and the front shell is virtually eliminated.

SUMMARY OF THE INVENTION

This invention relates to a shielded connector assembly comprising an insulating housing having a front part, a rear part, and female connector parts. Contacts are disposed in the female connector parts and a metal shell is attached to the insulating housing. The metal shell has a specified plate thickness and has a grounding tongue that elastically contacts mating male connectors that are connected to the female connector parts. A front shell made of metal is externally mounted on the front part of the insulating housing. The front shell has a plate thickness that is thicker than that of the metal shell and is fastened to the insulating housing such that it contacts the metal shell.

BRIEF DESCRIPTION OF THE DRAWINGS

FIG. 12A is a plan view of the metal shell.

FIG. 12B is a front view of the metal shell.

FIG. 12C is a left-side view of the metal shell.

FIG. 12D is a right-side view of the metal shell.

DETAILED DESCRIPTION OF THE PREFERRED EMBODIMENT

Figure 1:
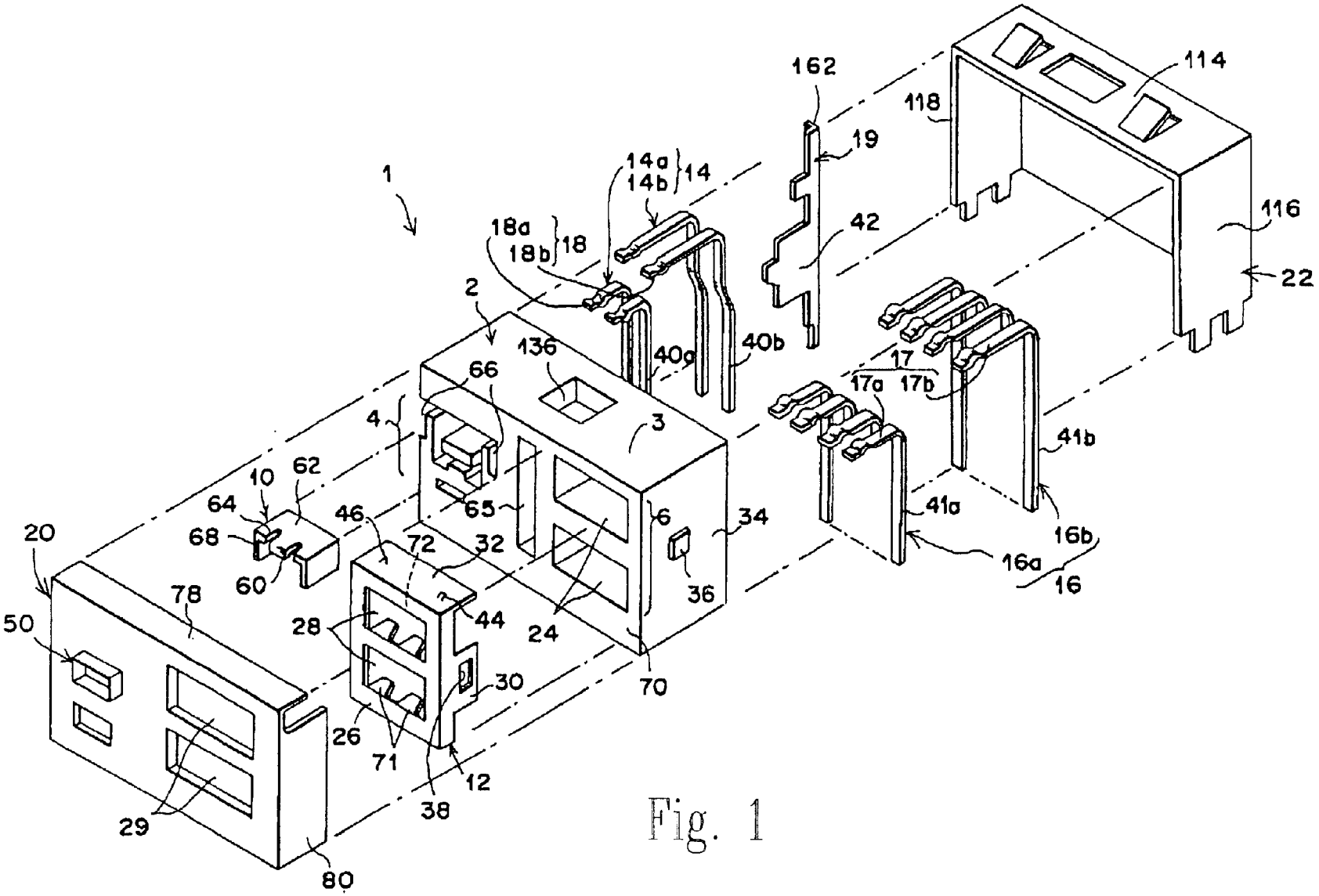
FIG. 1 is a schematic exploded perspective view that illustrates the schematic construction of the assembly of the present invention.

A preferred embodiment of the shielded connector assembly 1 of the present invention will be described in detail below with reference to the attached figures. It should be noted that while FIG. 1 shows a schematic construction of the assembly 1, the shapes of the detailed parts do not necessarily correspond with the constructions that will be described herein. Further, when reference is made to the forward-backward direction in the following description, the side to which a mating connector (not shown) is connected is taken as the front side, and the opposite side is taken as the rear side.

Shown in FIG. 1, the assembly 1 has a substantially rectangular-solid insulating housing 2 having female first and second connector parts 4 and 6, pluralities of first and second connector part contacts 14 and 16 respectively mounted in the first and second connector parts 4 and 6 from the rear part of the housing 2, and first and second metal shells 10 and 12 respectively attached to the front parts of the first and second connector parts 4 and 6. The assembly 1 also has a shielding plate 19 attached to the rear part of the housing 2 that is disposed between adjacent first connector part contacts 14, a front shell 20 attached to the front part of the housing 2, and a rear shell 22 attached to the rear part of the housing 2. Front shell openings 29 corresponding to connector part openings 24 in the housing 2 and rectangular openings 28 in the second metal shell 12 are formed in the front shell 20, thus forming the mating parts of the second connector part 6.

In the present embodiment, the first and second metal shells 10 and 12 are respectively formed from sheet metal with thicknesses of approximately 0.2 mm and 0.3 mm. The front shell 20 and rear shell 22 are formed by stamping and forming sheet metal with respective thicknesses of approximately 0.5 mm and 0.3 mm. Further, the attachment pitch of the first connector part contacts 14 is approximately 0.8 mm. The second connector part contacts 16 have a larger attachment pitch than the first connector part contacts 14.

As shown in FIG. 1, the first connector part 4 is constructed so that the first connector part 4 satisfies the standard of IEEE1394. The second connector part 6 is constructed so that the second connector part 6 satisfies the USB standard. The first connector part contacts 14 have first connector part contact parts 18 and comprise first contacts 14*a* having first contact parts 18*a* and second contacts 14*b* having second contact parts 18*b*. The first connector part contacts 14 are disposed so that the first connector part contact parts 18 of the first connector part contacts 14 form a single row in the first connector part 4. The first connector part contacts 14 are bent into a substantially L-shape, and the first contacts 14*a* and second contacts 14*b* are alternately disposed in a single row.

Figure 8:
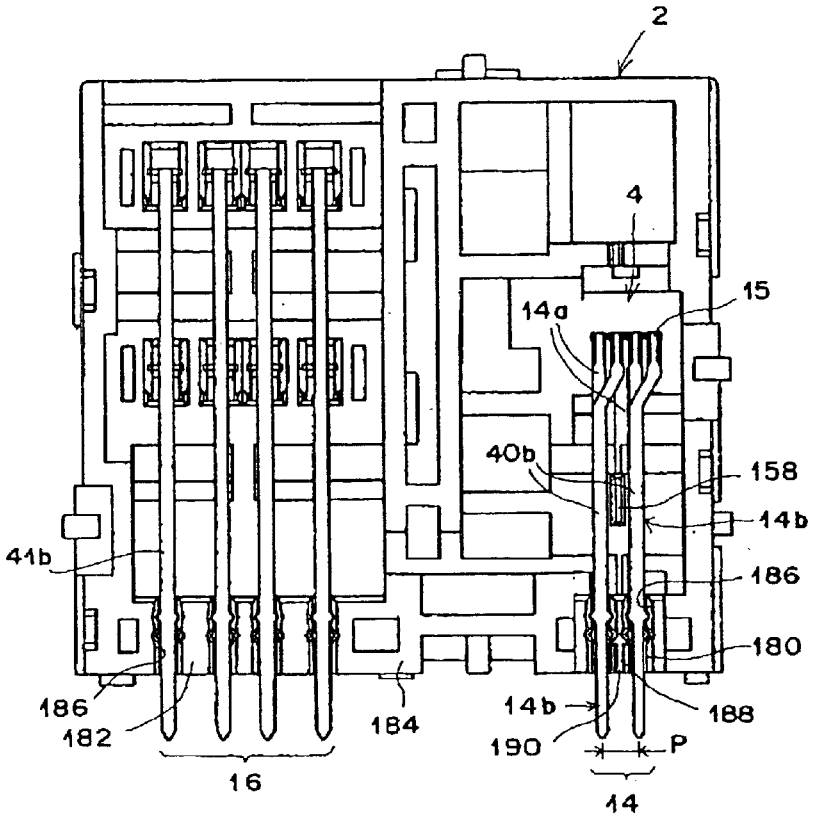
FIG. 8 is a rear view of the housing with attached contacts.

The second contact parts 18*b* of the second contacts 14*b* are longer than the first contact parts 18*a* of the first contacts 14*a*. Accordingly, second tine parts 40*b* of the second contacts 14*b* are positioned to the rear of first tine parts 40*a* of the first contacts 14*a*. Further, the second tine parts 40*b* are offset so that the second tine parts 40*b* are aligned with the first tine parts 40*a*, i.e., aligned in the forward-rearward direction perpendicular to the row direction, as shown in FIG. 8. The shielding plate 19 has a shielding surface 42 that extends in the forward-rearward direction. The shielding surface 42 is disposed in a space that is located in the vicinity of the first and second tine parts 40*a*, 40*b* and is formed in the row direction as a result of the second tine parts 40*b* being offset. The shielding surface 42 prevents crosstalk between the adjacent first connector part contacts 14.

The first metal shell 10 has a substantially squared C shape in cross section, and has a grounding tongue 60 that is cut and raised by forming slots 64 in both sides of the front end of the upper wall 62. The grounding tongue 60 is bent inward at an inclination. The grounding tongue 60 contacts the shell of the mating male connector (not shown) to establish a ground connection. The first metal shell 10 is inserted and attached in cut-outs 66 formed in the housing 2 in the upper part of the first connector part 4. In this case, the front end of the first metal shell 10 and the front surface 70 of the housing 2 are substantially coplanar. One side wall 68, positioned on the outside of the first metal shell 10, is exposed on the outside of the housing 2. The exposed side wall 68 contacts the front shell 20 as will be described in detail below.

In the second connector part 6, the connector part openings 24 that accommodate the mating male connectors (not shown) are formed above and below in the housing 2. Fourth contacts 16*b* are disposed in the upper connector part opening 24, and third contacts 16*a* are disposed in the lower connector part opening 24. The second metal shell 12 attached to the second connector part 6 has a face plate 26 having two rectangular openings 28 formed in positions corresponding to the connector part openings 24, and four tabs 30, 32 extending rearward from the face plate 26 as integral parts. The tabs 30 have rectangular openings 38. One of the rectangular openings 38 engages with a rectangular projection 36 that protrudes from the side surface 34 of the housing 2. As shown in FIG. 1, the tab 30 on the opposite side is arranged so that the tab 30 engages with a projection (not shown) located inside a groove 65 in the housing 2 in a position corresponding to the tab 30. The second metal shell 12 is fastened to the housing 2 as a result of the engagement. The rectangular openings 28 in the second metal shell 12 have the same shape as the connector part openings 24 in the housing 2. Two grounding tongues 71 are formed on the lower edge of each rectangular opening 28. The grounding tongues 71 are oriented inward at an inclination, and a single tongue 72 (hidden from view in FIG. 1) is similarly formed on the upper edge of each rectangular opening 28 so that the single tongue 72 is oriented inward at an inclination. When the mating connector (not shown) is connected, the grounding and single tongues 71 and 72 contact the outer shell of the mating connector (not shown) to establish a ground connection. The metal shell 12 is formed from a relatively thin metal plate so that the elasticity of the tongue parts 71 and 72 is optimal.

When the front shell 20 is externally mounted on the housing 2, the front shell 20 contacts the second metal shell 12 to establish electrical continuity between the second metal shell 12 and the front shell 20. The electrical continuity may be established by contact between the front surface of the second metal shell 12 and the inside surface of the front shell 20 or may be established by providing a projection 46 and/or a cut and raised tongue 44 on the upper tab 32 of the second metal shell 12 to establish positive contact with the front shell 20.

Figure 2:
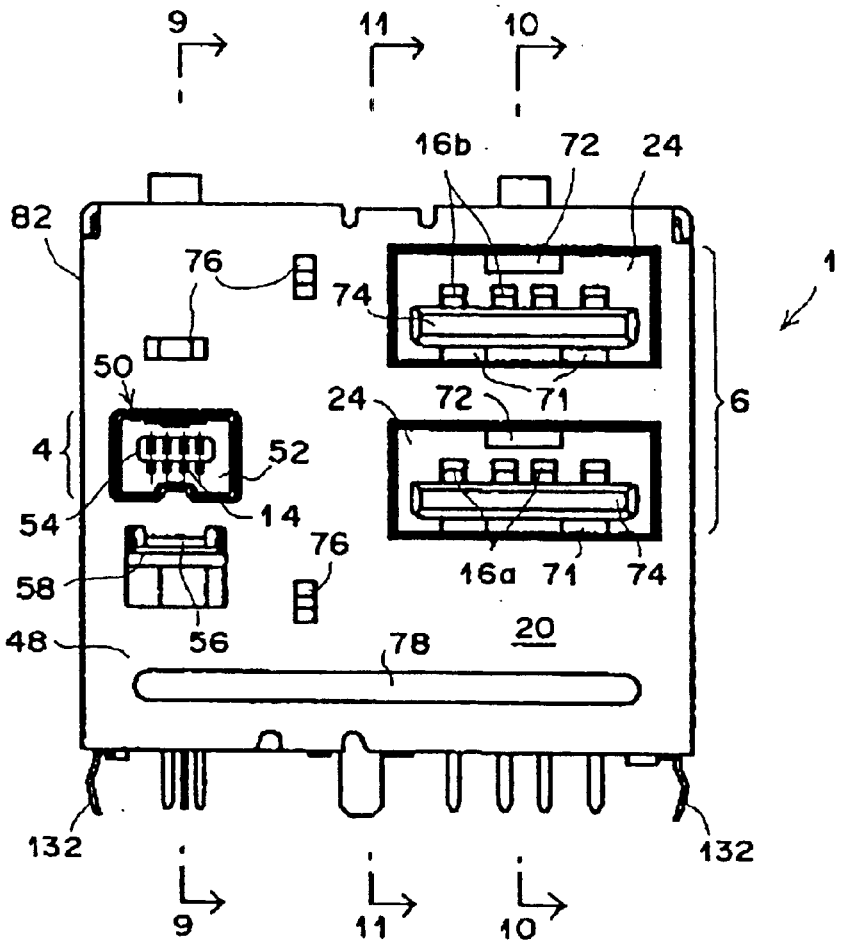
FIG. 2 is a front view of the assembly shown in FIG. 1.
Figure 9:
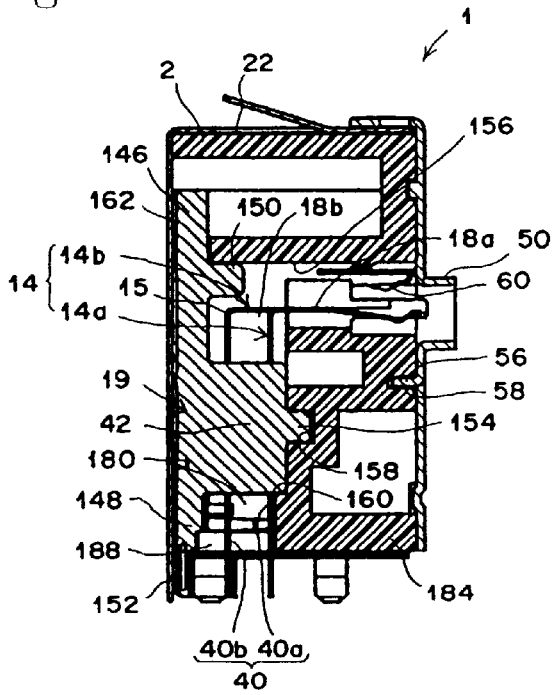
FIG. 9 is a sectional view of the assembly along line 9—9 in FIG. 2.

The assembly 1 will now be described in greater detail with reference to FIGS. 2 through 7. As shown in FIG. 2, a substantially rectangular mating part 50 protrudes from the flat main surface of the front shell 20 in a position corresponding to the first connector part 4. A mating opening 52 mated with the mating connector (not shown) is formed in the mating part 50. Inside the mating opening 52, a flat-plate part 54 extends in the horizontal direction. First connector part contacts 14 provided on the flat-plate part 54 can be seen inside the first connector part 4. A tongue 56 is cut and raised and extends rearward on the main surface 48 beneath the mating part 50. The tongue 56 is press-fitted in a slot 58 in the housing 2 and is used to position the front shell 20 in the vertical and left-right directions in FIG. 2. The tongue 56 prevents positional deviation between the mating part 50 and the housing 2 caused by wrenching of the mating connector (not shown) that is passed through the mating part 50, as shown in FIG. 9. This ensures accurate positioning since the mating part 50 of the first connector part 4 is constructed by means of a front shell 20 that is separate from the housing 2.

As shown in FIG. 2, a flat-plate part 74 extends in the direction of width of each connector part opening 24, i.e., in the horizontal direction in FIG. 2, and protrudes toward the front inside each connector part opening 24 of the second connector part 6. The second connector part contacts 16 (16*a*, 16*b*) are disposed on the upper surface of the flat-plate part 74. The tongues 71 and 72 protrude slightly into the interior of each connector part opening 24 from the upper and lower edges of each connector part opening 24. Oblong recesses 76 and a recessed bead 78 that extends across substantially the entire width of the main surface 48 in the lower part of the main surface 48 are formed in the main surface 48 of the front shell 20. The recesses 76 and the bead 78 position the front shell 20 with respect to the housing 2 by engaging with corresponding grooves (not shown) formed in the front surface 70 of the housing 2.

As shown in FIGS. 3 through 6, the front shell 20 has an upper wall 78 and side walls 80 and 82. The upper wall 78 and side walls 80 and 82 are positioned on the outside of the front part of the housing 2, and portions of the upper wall 78 and side walls 80 and 82 are fastened to the housing 2 by partial crimping. The conditions of the crimping will be described in detail below with reference to FIGS. 3 through 6. A first small part 92 extends rearward and is formed in a position that is shifted slightly to one side from the center of the upper wall 78. Cut-outs 84 and 86 are formed on both sides of the first small part 92 so that the first small part 92 is made bendable. A second small part 94 is similarly formed by cut-outs 86, 86 in the side wall 80, and a third small part 96 is also similarly formed in the side wall 82. Further, a fourth small part 98 is provided to protrude from the lower end 100 of the front shell 20.

Slots 90 extending in the forward-rearward direction are formed in the approximate centers of the small parts 92 through 98. Recesses 102 through 108 are formed in the front surface 70 of the housing 2 in respective positions corresponding to the small parts 92 through 98, and the respective small parts 92 through 98 are fastened by crimping so that the small parts 92 through 98 can bend with respect to the recesses 102 through 108. Ridges 110, of a length that engage with slots 90 formed in the small parts 92 through 98, are formed in portions of the housing 2 that correspond to the slots 90. Accordingly, the front shell 20 is fastened and positioned securely. After the front shell 20 has been fastened to the housing 2, a gap allowing only the accommodation of the rear shell 22 is maintained between the outer walls of the housing 2 and the upper wall 78 and side walls 80 and 82 of the front shell 20.

Figure 3:
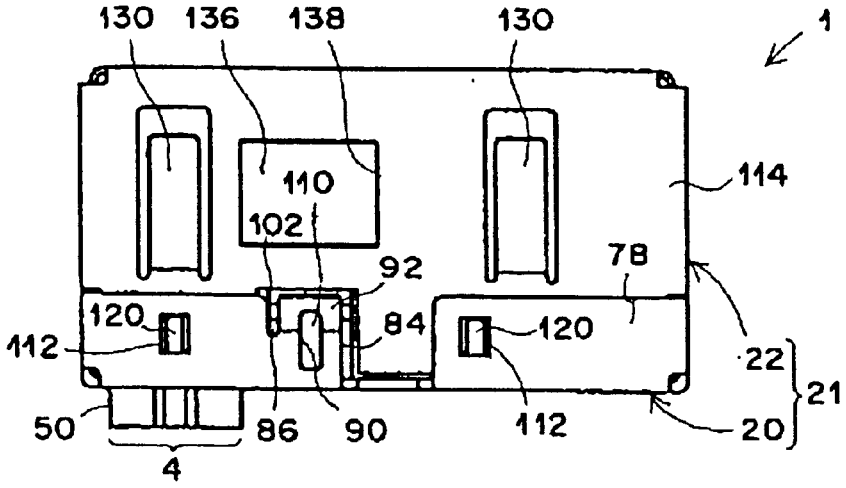
FIG. 3 is a plan view of the assembly shown in FIG. 1.
Figure 4:
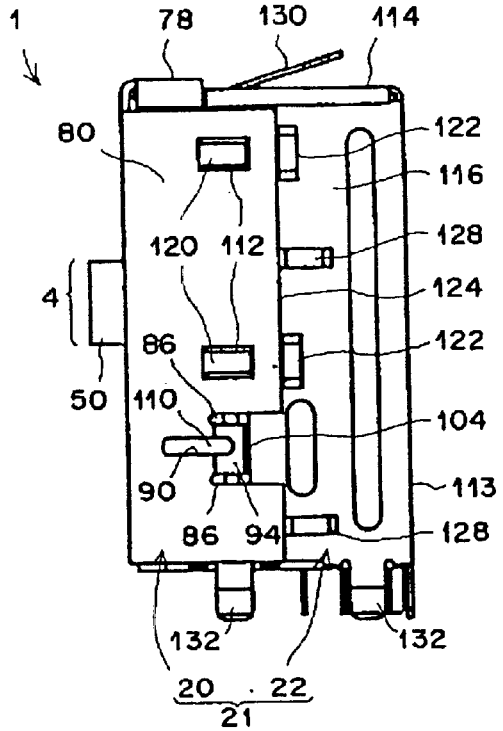
FIG. 4 is a right-side view of the assembly shown in FIG. 1.
Figure 5:
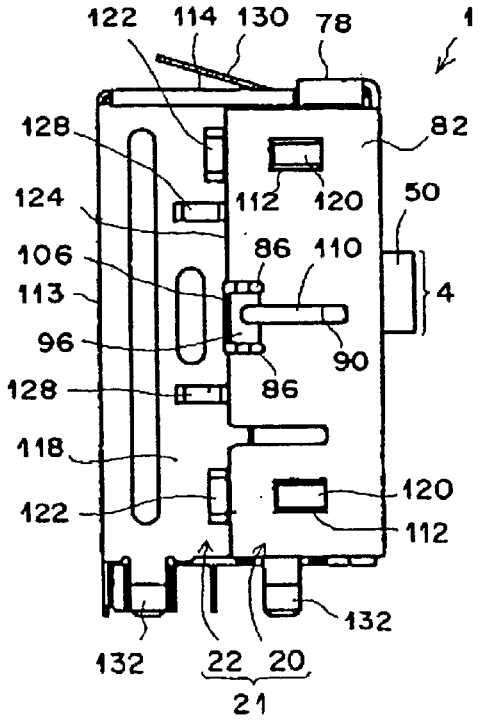
FIG. 5 is a left-side view of the assembly shown in FIG. 1.
Figure 6:
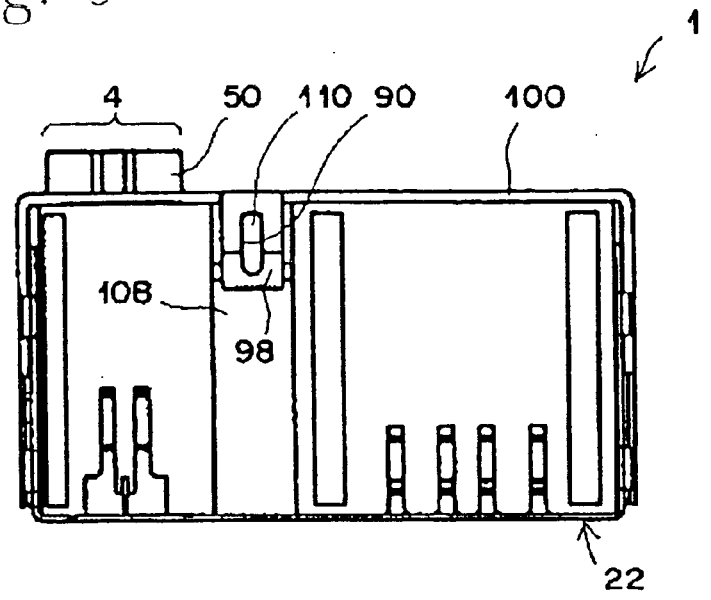
FIG. 6 is a bottom view of the assembly shown in FIG. 1.

As shown in FIGS. 3 through 5, small rectangular engaging holes 112 extend slightly in the forward-rearward direction and are formed in the upper wall 78 and side walls 80 and 82 of the front shell 20. Two engaging holes 112 are formed in each wall for mechanical engagement with the rear shell 22.

The rear shell 22 will now be described in greater detail with reference to FIGS. 3 through 7. Shown in FIG. 7, the rear shell 22 has a main surface 113, an upper wall 114 and side walls 116 and 118 that extend forward from the main surface 113. Latching arms 120 that are slightly smaller than the engaging holes 112 are formed on the upper wall 114 and side walls 116 and 118 in positions that correspond to the engaging holes 112 when the rear shell 22 is attached to the housing 2. The latching arms 120 are formed by being cut and raised so that the latching arms 120 extend upward at an inclination toward the rear. Accordingly, when the respective walls of the rear shell 22 are disposed inside the corresponding walls of the front shell 20, the latching arms 120 engage with the engaging holes 112, so that the rear shell 22 is fastened to the front shell 20. Further, protruding parts 122 positioned at the rear ends 124 of the side walls 80 and 82 of the front shell 20 protrude from the side walls 116 and 118 of the rear shell 22 by embossing. The positioning of the rear shell 22 is also securely accomplished by means of the protruding parts 122. The mechanical engagement of the front shell 20 and rear shell 22 establishes an electrical connection that forms an integral shielding shell 21 covering the housing 2.

Ridges 128 are formed on the side walls 116 and 118 and protrude inward and extend in the forward-rearward direction. The ridges 28 slide through the interiors of corresponding guide grooves (not shown) that extend in the forward-rearward direction of the housing 2 when the rear shell 22 is mounted on the housing 2 to ensure that the rear shell 22 can be smoothly mounted on the housing 2.

The contact beams 130 are cut and raised from the upper wall 114 of the rear shell 22. The contact beams 130 extend rearward at an inclination and contact the device housing body (not shown) in which the assembly 1 is mounted to establish a ground connection. Attachment legs 132 protrude from the lower edges of the side walls 116 and 118 of the rear shell 22. Two attachment legs 132 protrude from each side wall. The attachment legs 132 are bent into a shallow V-shape that bows outward and are inserted into corresponding holes in the attachment board (not shown). As shown in FIG. 5, the portion of the rear shell 22 that is located directly above the attachment legs 132 on the front side is supported by the front shell 20, which has a large thickness. Accordingly, the attachment legs 132 do not easily open to the outside, so that alignment with the apertures in the board into which the attachment legs 132 are inserted can be maintained.

As shown in FIG. 3, an opening 138 is formed in the upper wall 114 of the rear shell 22 in a position corresponding to a square hole 136 formed in the upper wall 3 of the housing 2. A portion of the device (not shown) engages with the square hole 136 (opening 138) and supports the assembly 1, so that no excessive stress is applied to the board attachment parts, i.e., tine soldering parts (not shown), of the assembly 1 when the mating connector (not shown) is inserted and removed.

Figure 7:
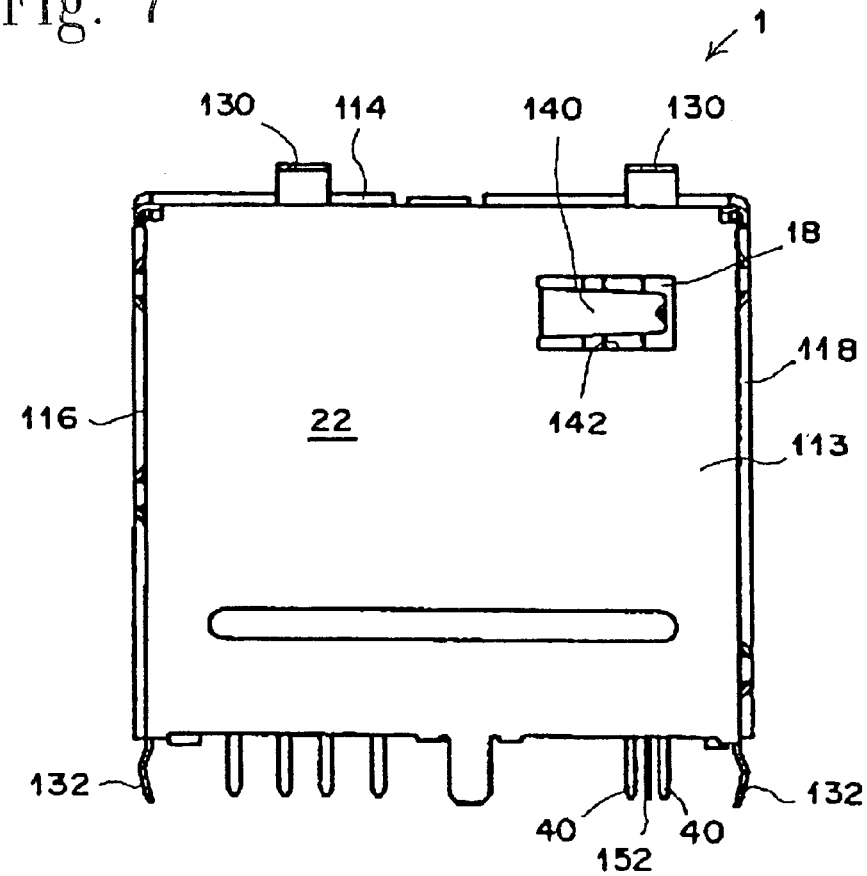
FIG. 7 is a rear view of the assembly shown in FIG. 1.

As shown in FIG. 7, a contact beam 140 is formed by an opening 142 in a position corresponding to the shielding plate 19 of the first connector part 4. The contact beam 140 is formed so that the contact beam 140 extends horizontally and inward toward the side wall 118 (toward the front) in the main surface 113 of the rear shell 22. The contact beam 140 makes elastic contact with the rear end of the shielding plate 19 and is electrically connected to the shielding plate 19. As a result, the shielding plate 19 and the shielding shell 21 that covers the housing 2 form an integral unit, so that the first connector part 4 is also protected against Electromagnetic Interference (EMI).

The details of the positional relationship between the shielding plate 19 and the first connector part contacts 14 will now be described with reference to FIGS. 8 and 9. As shown in FIG. 8, the second tine parts **40*b* of the second contacts 14*b* on the rear side of the first connector part 4 are offset in the vicinity of bent parts 15 toward the tine parts 40*a*, shown in FIG. 9, of the first contacts 14*a* on the front side, so that the second tine parts 40*b* are lined up to the rear of the tine parts 40*a*. As a result, the spacing between the second tine parts 40*b* and the spacing between the tine parts 40*a* in the row direction (the left-right direction in FIG. 8) are the same, and the pitch P in the left-right direction is twice the pitch of the first connector part contact parts 18. Accordingly, the shielding plate 19 can be inserted into the space between the second tine parts 40*b* that is obtained as a result of the offset. As shown in FIG. 9, the second contact parts 18*b* of the second contacts 14*b* are longer than the first contact parts 18*a* of the first contacts 14*a* and the shielding surface 42 of the shielding plate 19 is disposed between the tine parts 40 of the first connector part contacts 14**.

As shown in FIG. 9, the shielding plate 19 has a substantially rectangular flat-plate-form shielding surface 42. Respective extension parts 146 and 148 extend upward and downward from the rear side of the shielding surface 42 and are integrally formed by stamping from a single metal plate. The extension part 146 is formed so that the extension part 146 is longer than the extension part 148. A first tab 150 extending in the same direction as the shielding surface 42 is formed in the approximate center of the extension part 146. A tine 152, used for board attachment, extends downward from the lower end of the extension part 148 and is formed on the extension part 148. A second tab 154, similar to the first tab 150, is formed on the tip end of the shielding surface 42. When the shielding plate 19 is attached facing forward from the rear part of the housing 2, the first tab 150 engages with the inside wall 156 of the housing 2. The second tab 154 is press-fitted in a recessed part 158 of the housing 2, so that the lower part of the front end of the shielding surface 42 is seated on a step part 160 of the housing 2. As a result, the shielding plate 19 is fastened to the housing 2 so that the shielding surface 42 partially shields the tine parts **40*a* and 40*b*. It is desirable that a contact surface 162 which is perpendicular to the shielding surface 42 be formed in an L-shape on the rear part of the shielding plate 19 so that the contact surface 162 runs from the approximate center of the shielding plate 19 (with respect to the direction of height) to the upper end of the shielding plate 19. The contact surface 162 contacts the contact part 140 of the rear shell 22, so that the contact surface 162 is electrically connected to the rear shell 22**.

Figure 10:
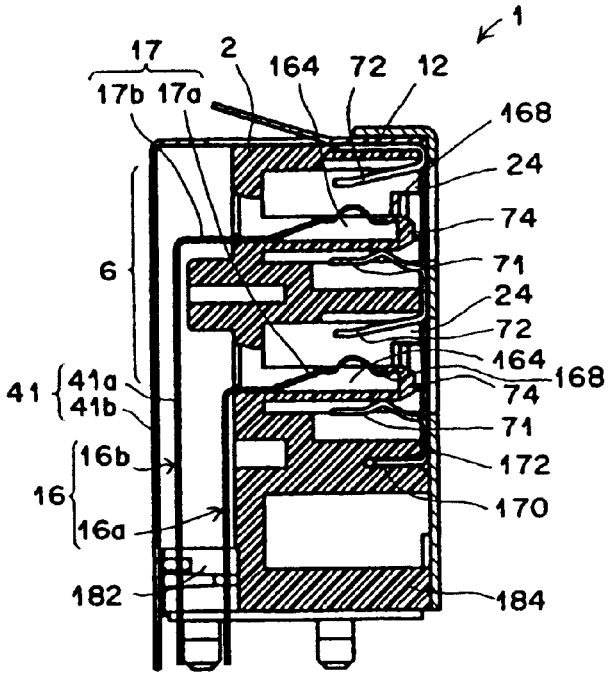
FIG. 10 is a sectional view of the assembly along line 10—10 in FIG. 2.

The internal structure of the second connector part 6 will now be described in greater detail. As shown in FIG. 10, the flat-plate parts 74 protrude as integral parts of the housing 2 into the upper and lower openings 24 of the second connector part 6. Contact accommodating grooves 164 extend in the forward-rearward direction and are formed in the respective flat-plate parts 74. The second connector part contact parts 17 of the L-shaped second connector part contacts 16 are accommodated in the contact accommodating grooves 164. In this case, the tip ends of the second connector part contact parts 17 are anchored to the inside walls 168 of the accommodating grooves 164, so that the second connector part contact parts 17 are held in a state in which the second connector part contact parts 17 are urged upward. Accordingly, the second connector part contact parts 17 can be provided to flex elastically upward and downward by the insertion and removal of the mating connectors (not shown). Further, the tongues 72 of the second metal shell 12 are disposed facing inward at an inclination inside the openings 24. A tab 170 on the lower end of the second metal shell 12 is inserted into a groove 172 in the housing 2, to position the second metal shell 12. The front shell 20 and second metal shell 12 overlap and contact each other.

Figure 11:
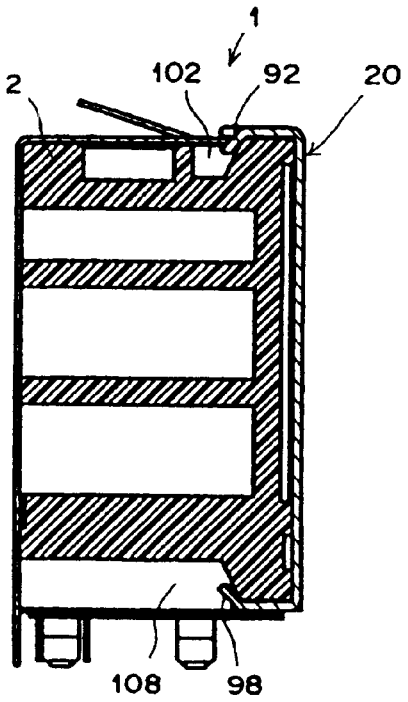
FIG. 11 is a sectional view of the assembly along line 11—11 in FIG. 2.

The crimping of the front shell 20 will now be described with reference to FIG. 11. As shown in FIG. 11, the upper and lower small parts 92 and 98 of the front shell 20 are respectively bent and crimped inside the recesses 102 and 108 of the housing 2. The other small parts 94 and 96 are crimped in a similar state (the sectional view is omitted).

The tine holding parts will now be described in greater detail. Shown in FIGS. 8 and 9, the tine holding part 180 is formed as an integral part of the bottom wall 184 of the housing 2 in the lower part of the housing 2, and holds the tine parts 40 of the first connector part contacts 14. The tine holding part 182, shown in FIGS. 8 and 10, holds the tine parts 41 of the second connector part contacts 16. The tine holding parts 180 and 182 hold the tine parts 40 and 41 in positions corresponding to the through-holes in the boards, and have holding grooves 186 that open to the rear. The tine parts 40 and 41 are aligned in positions corresponding to the through-holes (not shown) of the board by the tine holding parts 180 and 182.

A shielding plate holding part 188 is formed between the two holding grooves 186 in the first connector part 4. Shown in FIG. 8, the shielding plate holding part 188 has a holding groove 190 that opens to the rear in the same manner as the holding grooves 186. The extension part 148 that extends downward from the shielding plate 19 and is accommodated inside the holding groove 190 to position the tine 152 that extends downward as a continuation of the extension part 148. Since the gap between the second tine parts 40*b*, 40*b* of the adjacent first connector part contacts 14 is expanded from approximately 0.8 mm to approximately 1.6 mm as a result of the offset of the second tine parts 40*b*, the shielding plate 19 can be appropriately disposed without contacting the adjacent first connector part contacts 14 to prevent crosstalk.

The second metal shell 12 will now be described in greater detail with reference to FIGS. 12A through 12D. The projection 46 formed on the tab 32 located on the top part has a triangular shape formed by stamping. Positive contact is made with the front shell 20 by the tip end of the projection 46. The tongue 44 is formed facing forward and upward inside the opening 45. The tongue 44 is arranged so that the tongue 44 makes elastic contact with the front shell 20. The single tongue part 72 formed on the upper side inside each opening 28 of the face plate 26 is positioned at an intermediate point between the two tongue parts 71 formed in positions removed from each other on the lower side inside each opening 28. As single opening 38 is formed in the side part of tab 30, which constitutes a part of the outside of the housing 2. Two openings 38 are formed in the tab 30', which constitute a part of the inside of the housing 2. Accordingly, fastening is accomplished at two locations on the inside of the housing 2.

As described above, the plate thickness of the front shell 20 is approximately 0.5 mm, so that the front shell has sufficient strength. Accordingly, following crimping, the bent state of the front shell 20 is securely maintained without loosening. If tongues were constructed by means of the front shell 20 instead of using the tongues 71 and 72 of the second metal shell 12, appropriate elastic deformation in response to the insertion and removal of the mating connector (not shown) would be unachievable. Thus, insertion and electrical connection of the male connectors (not shown) would be impossible, since tongues with the plate thickness of as much as 0.5 mm have limited flexibility. Resultantly, the second metal shell 12 and front shell 20 are constructed as separate parts. Further, it will be appreciated by those skilled in the art that the fastening of the front shell 20 to the housing 2 need not necessarily be accomplished by crimping, but may be accomplished by other means such as fastening by latching engagement.

The exposed side wall 68 of the first metal shell 10 contacts the inside surface of the side wall 82 of the front shell 20 and is electrically connected to the front shell 20 as a result of the mounting of the front shell 20. The front shell 20 is also electrically connected to the rear shell 22, thus forming the shielding shell 21 that covers the housing 2. As a result, in addition to crosstalk prevention, the first connector part 4 can also be protected against EMI.

Advantageously, a shielded connector assembly can be provided in which the strength of the front shell constituting the connector engaging part is high while having a metal shell plate thickness which sufficiently satisfies the elasticity requirements stipulated by standards, and in which relative positional deviation between the metal shell and the front shell tends not to occur. Further, in cases where the shielded connector assembly of the present invention is constructed so that a rear shell made of metal is externally mounted on the insulating housing from the rear part of the insulating housing, and the front shell and rear shell are mechanically and electrically engaged with each other, a shielded connector assembly which prevents EMI can be obtained. Additionally, in cases where the front shell is fastened to the insulating housing by crimping, the front shell can be fastened to the insulating housing with sufficient attachment strength.

We claim:

1. A shielded connector assembly comprising:

an insulating housing having a front part, a rear part, and female connector parts;

contacts disposed in the female connector parts;

a metal shell having a grounding tongue, a first plate thickness, and attached to the insulating housing;

a front shell made of metal and having a second plate thickness greater than the first plate thickness, and externally mounted on the front part of the insulating housing such that the front shell contacts the metal shell; and wherein the grounding tongue elastically contacts mating male connectors that are connected to the female connector parts.

2. The shielded connector assembly of claim 1, wherein the front shell is fastened to the insulating housing by crimping.

3. The shielded connector assembly of claim 1, wherein the metal shell has a tab for attachment to the insulating housing.

4. The shielded connector assembly of claim 1, wherein the metal shell has a projection that makes positive contact with the front shell.

5. The shielded connector assembly of claim 1, wherein the metal shell has a tongue positioned to make elastic contact with the front shell.

6. The shielded connector assembly of claim 1, further comprising a rear shell made of metal and externally mounted on the insulating housing from the rear part of the insulating housing such that the front shell and the rear shell are mechanically and electrically engaged with each other.

7. The shielded connector assembly of claim 6, wherein the front shell is fastened to the insulating housing by crimping.

* * * * *

UNITED STATES PATENT AND TRADEMARK OFFICE

CERTIFICATE OF CORRECTION

PATENT NO. : 6,629,859 B2
DATED : October 7, 2003
INVENTOR(S) : Hoshino et al.

It is certified that error appears in the above-identified patent and that said Letters Patent is hereby corrected as shown below:

Title page,
Item [30], Foreign Application Priority Data, "Jan. 31, 2001 (JP) . . . . . 2001-024484" should be deleted.

Signed and Sealed this

Twenty-seventh Day of January, 2004

JON W. DUDAS
*Acting Director of the United States Patent and Trademark Office*